United States Patent [19]

Kubo

[11] Patent Number: 5,024,248

[45] Date of Patent: Jun. 18, 1991

[54] TWO-POSITION AND THREE-WAY VALVE

[75] Inventor: Chikanari Kubo, Sagamihara, Japan

[73] Assignee: Eishin Technology Company, Limited, Japan

[21] Appl. No.: 398,147

[22] Filed: Aug. 24, 1989

[30] Foreign Application Priority Data

Mar. 10, 1989 [JP] Japan ..... 1-56218

[51] Int. Cl.[5] ..... F15B 13/043

[52] U.S. Cl. ..... 137/596.16; 137/596.14

[58] Field of Search ..... 137/596.14, 596.16, 137/596.15, 596.18

[56] References Cited

U.S. PATENT DOCUMENTS

| | | | |
|---|---|---|---|
| Re. 29,481 | 11/1977 | Larner | 137/596.16 X |
| 2,984,218 | 5/1961 | Christianson | 137/596.15 |
| 2,984,257 | 5/1961 | McCormick et al. | 137/596.16 X |
| 3,016,918 | 1/1962 | Wentworth | 137/596.16 |
| 3,080,887 | 3/1963 | Brandenberg | 137/596.14 |
| 3,704,721 | 12/1972 | Schmitz et al. | 137/596.16 X |
| 3,905,393 | 9/1975 | Hartwig | 137/596.14 |
| 4,102,355 | 7/1978 | Hansen | 137/596.14 X |
| 4,169,490 | 10/1979 | Taplin | 137/596.15 X |
| 4,744,388 | 5/1988 | Ariizumi et al. | 137/596.14 |
| 4,787,415 | 11/1988 | Teltscher | 137/596.15 |

*Primary Examiner*—Gerald A. Michalsky

*Attorney, Agent, or Firm*—Andrus, Sceales, Starke & Sawall

[57] ABSTRACT

The present invention provides a two-position and three-way valve system having a fluid supply port, a fluid inlet port and a fluid outlet port, the valve system being characterized by a first section connecting the fluid supply port with the fluid inlet port, a second section connecting the fluid outlet port with the fluid inlet port, a valve device including a valve member mounted in each of the first and second sections to open or close a flow passage associated therewith, and an actuator mounted to actuate each of the valve members in an independent manner, the actuator means being rapidly operable in response to a control signal.

1 Claim, 2 Drawing Sheets

TWO-POSITION AND THREE-WAY VALVE

BACKGROUND OF THE INVENTION

1. Field of the Invention

The present invention relates to a three way valve and more particularly to a two-position and three-way valve.

2. Description of the Prior Art

In order to maintain a fluid within a vessel at a constant pressure, the prior art used a combination of a valve actuatable in response to the fluid pressure within a predetermined range of pressure with a control. If a plurality of valves are used, such a combination requires any actuator for rapidly controlling the valves and the control together so that the amount of the fluid held within the vessel can be varied with the passage of time in any remote control manner.

One of the most general forms of such a combination comprises a plurality of regulator and valve pairs. Among them, the modern systems includes an electropneumatic analog regulator system consisting of a controller and three way valves and an on-off control system comprising, in combination, a controller connected with two inlet and outlet two-way valves through a pressure intensifier.

Although the first-mentioned regulator-valve pair system is simple in construction, it requires the number of regulator-valve combinations equal to the number of necessary settings. Thus, such a system is bulky and troublesome in operation since the settings must be manually made separately.

The electropneumatic analog regulator system can be reduced in size and set more simply, but is expensive and inferior with respect to responsibility.

Although the on-off control system is less expensive and more simple in construction than the two aforementioned prior art systems, a valve currently used therein is generally insensitive in operation so that the valve cannot be actuated rapidly in response to variable parameter to provide an increased accuracy in comparison with the two aforementioned prior art systems.

SUMMARY OF THE INVENTION

The present invention is directed to an on-off control system which includes valve means capable of operating at higher speed as a proportional control element and which is not inferior in simplicity, cost and performance to both of the regulator system and electropneumatic analog regulator system according to the prior art.

In order to cause a valve to actuate rapidly and positively in response to a control signal, a poppet valve is combined with a diaphragm into a single unit. The poppet valve is then movable without sliding friction.

The poppet valve will not be actuated directly by the signal from the controller. Prior to actuation of the poppet valve, an electromagnetic coil is energized to move a flapper mounted on a movable iron core. The movement of the flapper causes a nozzle to move so as to create a back pressure. This back pressure may be utilized to move the diaphragm which in turn actuates the poppet valve.

In such a manner, the valve can be actuated more rapidly and accurately than the prior art system in which the electromagnetic valve is actuated directly to open or close the flow passage.

In one preferred embodiment of the present invention, a pair of two-position valves are combined such that each of the valves can be actuated independently to control three flow passages irrespectively of each other. If required, two of the flow passages can be closed by the valves simultaneously.

DETAILED DESCRIPTION OF THE PREFERRED EMBODIMENT

Figure 1:
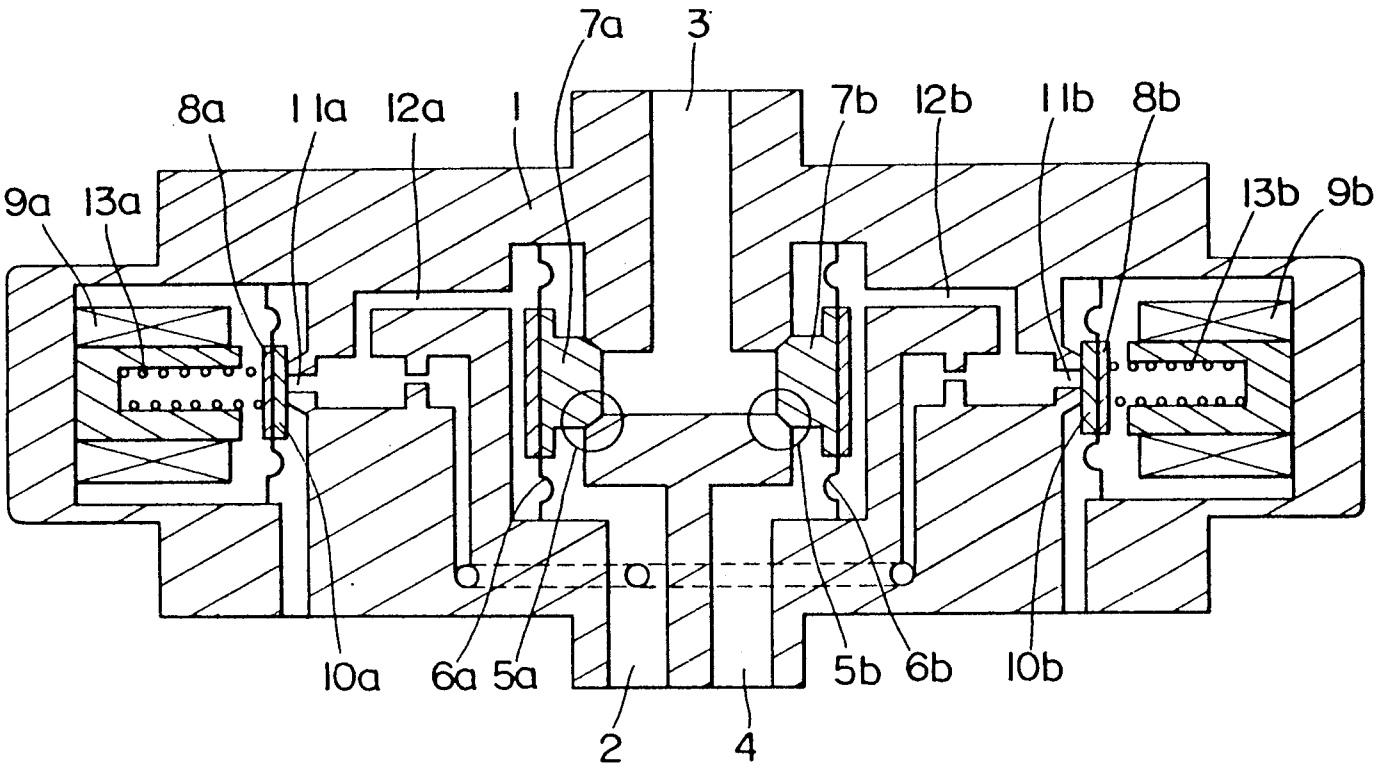
FIG. 1 is a longitudinal cross-section of one preferred embodiment of a two-position and three-way valve constructed in accordance with the present invention.

Referring now to FIG. 1, there is shown a valve system comprising a valve body 1 which is formed with three ports, that is, a fluid supply port 2, a fluid inlet port 3 and a fluid outlet port 4. The valve body 1 is divided into a first section A including a flow passage 5*a* connecting the fluid supply port 2 with the fluid inlet port 3 and a second section B including a flow passage 5*b* connecting the fluid inlet port 3 with the fluid outlet port 4. Each of these flow passages 5*a* and 5*b* includes a poppet valve 7*a* or 7*b* associated with a diaphragm 6*a* or 6*b*, which is characterized by the present invention. When the diaphragm 6*a* or 6*b* is moved, the poppet valve 7*a* or 7*b* also is moved to close or open the corresponding flow passage 5*a* or 5*b*. Only one of the first and second sections of the valve body will now be described below since they are identical with each other in construction and function.

The first section A of the valve body 1 includes an electromagnetic coil 9*a* mounted within the end portion thereof. The electromagnetic coil 9*a* is operatively associated with a movable iron core 8*a* which is rigidly connected with a flapper 10*a*. When the electromagnetic coil 9*a* is energized, the movable iron core 8*a* is moved away from a nozzle 11*a* formed in the valve body 1 to open it. The nozzle 11*a* is connected with one side of the poppet valve 7*a* through the fluid supply port 2 and also with the opposite side of the poppet valve 7*a* through the flow passage 12*a*.

Figure 3:
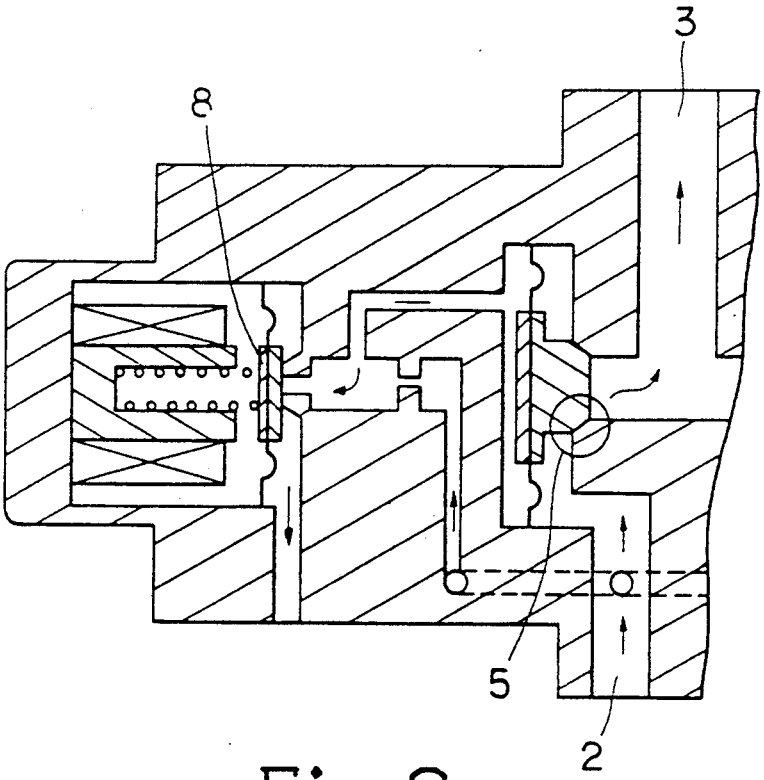
FIG. 3 is a fragmentary cross-section, shown by an enlarged scale, of the electromagnetic coil energized to open the flow passage.

When the nozzle 11*a* is opened by actuating the electromagnetic coil 9*a* as shown in FIG. 3, the pressure in the flow passage 12 decreases so that the poppet valve 7*a* will be opened under the supply pressure acting on the diaphragm 6*a* to open the flow passage 5*a*. Thus, the fluid will flow from the supply port 2 into the fluid inlet port 3 through the flow passage 5*a*.

Figure 2:
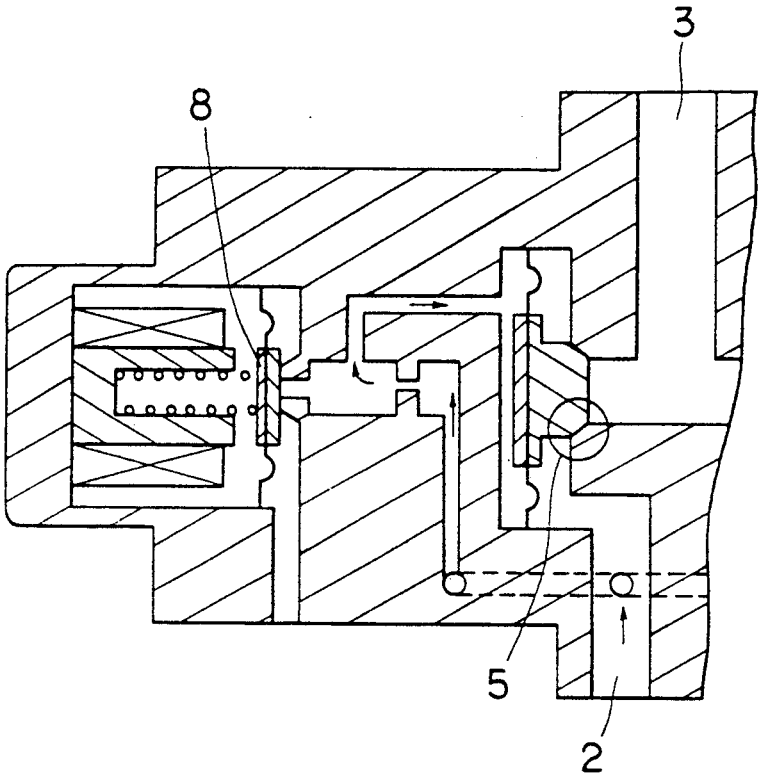
FIG. 2 is a fragmentary cross-section, shown by an enlarged scale, of an electromagnetic coil deenergized to close a flow passage.

On the contrary, when the electromagnetic coil 9*a* is deenergized, the flapper 10*a* integrally connected with the movable iron core 8*a* is moved under the action of a spring 13*a* to close the nozzle 11*a*, as shown in FIG. 2. Since the product of the back pressure within the flow passage 12*a* with the effective surface area of the diaphragm is larger than that of the effective surface area with the pressure in the supply side, the poppet valve 7*a* is moved to close the flow passage 5*a*.

As previously described, the flow passage 5*b* connecting the fluid supply port 3 with the fluid outlet port 4 is similarly controlled by the poppet valve 5*b* when the electromagnetic coil 9*b* is energized or deenergized with the nozzle 11*b* being opened or closed by the flapper 10*b* co-operating with the electromagnetic coil 9*b*.

In such an arrangement, the respective electromagnetic coils 9*a* and 9*b* can be controlled independently by the signal from the associated controller such that the flow passages 5*a* and 5*b* will be opened or closed irrespectively of each other.

Although the present invention has been described as to the two position and three-way valve system comprising two poppet valves electromagnetically controlled, it is not be limited to such an arrangement and can be applied with many changes and modifications without departing from the scope of the invention as defined in the appending claims.

I claim:

1. A two-position and three-way valve system, comprising:

a valve body having a fluid supply port for introducing pressurized fluid thereto, a fluid inlet port and a fluid outlet port, said fluid supply and outlet ports communicating through first and second passages, respectively, with said fluid inlet port;

valve means associated with said valve body and including a pair of movable valve members mounted to said valve body, each said valve member being adapted to open or close one of said first and second passages, and each said valve member comprising a diaphragm member mounted to said valve body and a poppet valve member secured to said diaphragm member, and wherein said first and second passages each include a valve seat for receiving one of said poppet valve members to close said passage; and actuator means associated with said valve body for actuating each of said valve members in an independent manner, said actuator means being rapidly operable in response to a control signal; said actuator means comprising a pair of electromagnetic coils and a pair of movable core members, and a nozzle flapper connected to each said core member, each said movable core member and nozzle flapper being movable in response to deenergization and energization of said coil toward and away from a nozzle to selectively close and open said nozzle; wherein each said movable core member and each said nozzle flapper are secured to an actuator diaphragm member mounted to said valve body, said actuator diaphragm member defining a portion of a flow path communicating between said nozzle and the exterior of said valve body.

* * * * *